United States Patent [19]

Higgins, Jr. et al.

[11] 4,429,289

[45] Jan. 31, 1984

[54] HYBRID FILTER

[75] Inventors: Robert J. Higgins, Jr., Sunrise; Harvey N. Turner, Jr., Tamarac, both of Fla.

[73] Assignee: Motorola, Inc., Schaumburg, Ill.

[21] Appl. No.: 383,418

[22] Filed: Jun. 1, 1982

[51] Int. Cl.[3] ..... H01P 1/203; H01P 7/08; H01P 5/00

[52] U.S. Cl. ..... 333/204; 333/202; 333/246

[58] Field of Search ..... 333/202-205, 333/219-221, 246, 238, 12; 361/390-401

[56] References Cited

U.S. PATENT DOCUMENTS

| | | | |
|---|---|---|---|
| 2,915,716 | 12/1959 | Hattersley | 333/204 |
| 3,506,932 | 4/1970 | Beurrier | 333/116 |
| 3,573,670 | 4/1971 | Skobern | 333/238 |
| 3,621,367 | 11/1971 | Rosen et al. | 333/204 X |
| 3,681,713 | 8/1972 | Degenkolb et al. | 333/203 |
| 3,701,958 | 10/1972 | Jaag | 333/185 |
| 3,818,389 | 6/1974 | Fisher | 333/203 |
| 3,820,044 | 6/1974 | Holland | 333/238 |
| 3,867,759 | 2/1975 | Siefker | 333/238 X |
| 3,992,686 | 11/1976 | Canning | 333/12 X |
| 4,020,428 | 4/1977 | Friend et al. | 333/203 |
| 4,110,715 | 8/1978 | Reindel | 333/204 |
| 4,179,673 | 12/1979 | Nishikawa et al. | 333/204 |

*Primary Examiner*—Marvin L. Nussbaum

*Attorney, Agent, or Firm*—James E. Jacobson; Edward M. Roney; James W. Gillman

[57] ABSTRACT

A hybrid filter comprising a plurality of removably mountable resonator modules, each constructed of nmicrostrip, and mounted parallel to each other and perpendicular to the substrate so as to isolate the resonators for single mode operation; the inter-resonator coupling is provided by adjustable capacitor coupling gaps on the host substrate.

5 Claims, 3 Drawing Figures

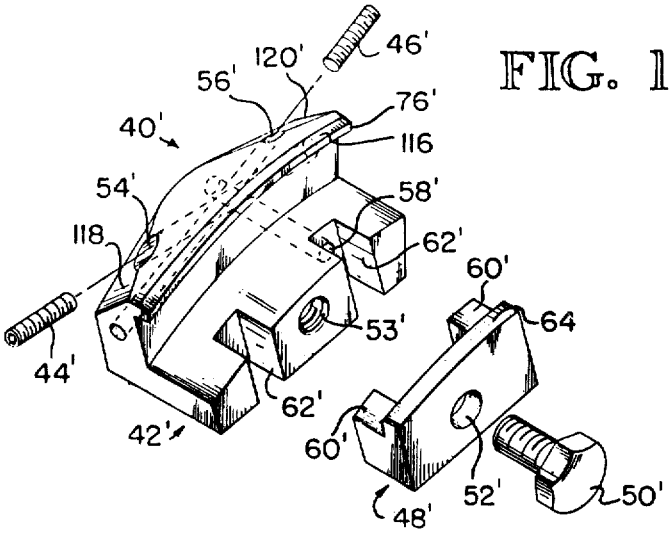
FIG. 18
FIG. 19
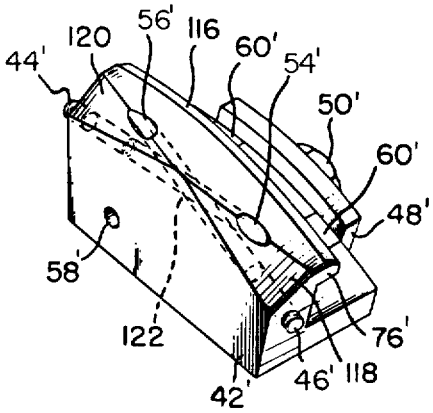
FIG. 20
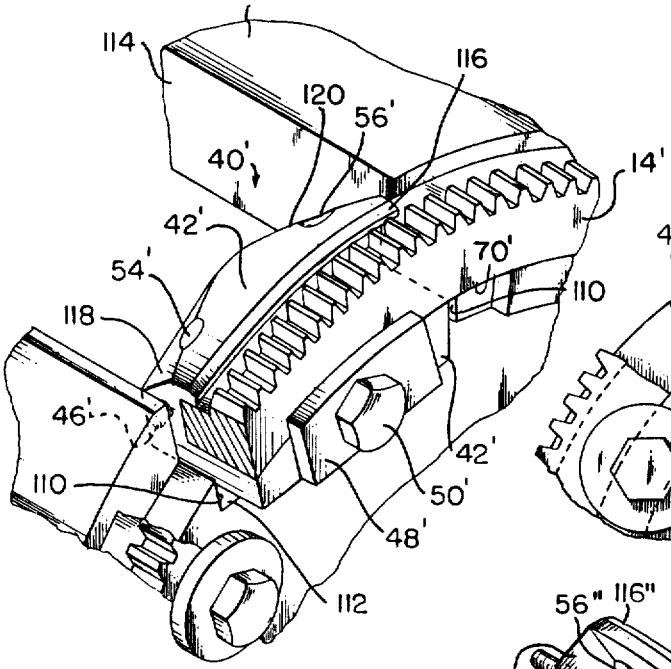
FIG. 21
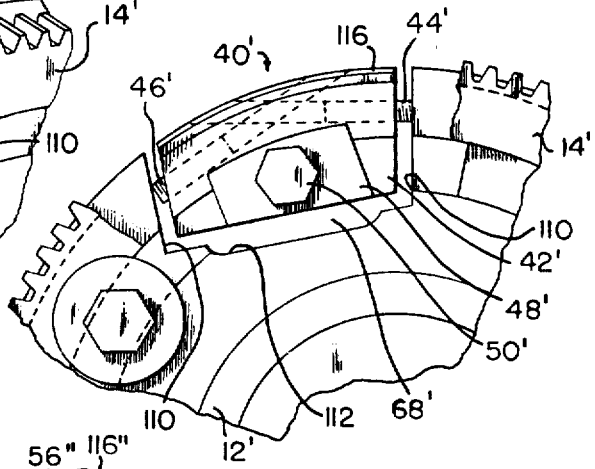
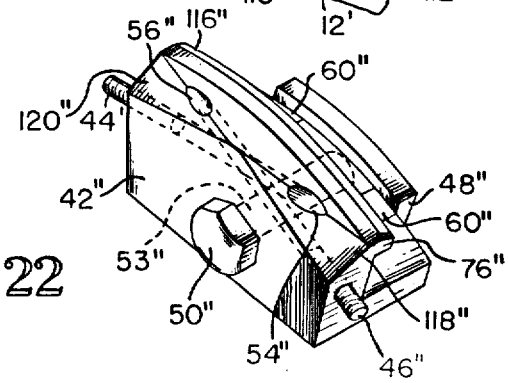
FIG. 22

HYBRID FILTER

BACKGROUND OF THE INVENTION

The present invention relates generally to high frequency filters and more particularly to an improved hybrid filter structure fabricated with plug-in resonant elements (elements of microstrip) and which filter may be tuned to a desired response after manufacture. This type of filter could be utilized in a high frequency (e.g. 400 Mhz) radio receiver to provide such functions as an injection filter or a preselector filter. The invention could also be used advantageously as a harmonic filter in a radio transmitter.

Filters are classified according to function (i.e., bandpass, lowpass, and high pass) and can be implemented in several common technologies. Typically filters are constructed of discrete components, or fabricated using printed circuit techniques such as stripline or microstrip. At the present time, microstrip filters are constructed using a planar approach, that is, the entire filter is fabricated on a single substrate, and since a microstrip filter is fabricated using printed circuit techniques, normally little can be done to tailor the filter's response after manufacture.

A major problem with microstrip filters in the past has been in coupling the individual resonators. Unlike many transmission lines, a microstrip resonator has separate and distinct effective dielectric constants depending on which coupled natural mode is excited. The electric flux distribution is distinctly different in each of these modes. An electromagnetic wave traveling through a filter with two coupled microstrip lines can exhibit two distinct propagation velocities depending on the excitation mode. The ultimate result of this phenemona is a high insertion loss for narrowband bandpass filters.

To overcome this problem, the present invention successfully separates the resonator and coupling sections. Since each resonator section comprises a ground plane, each resonator is self-shielding, and coupling between resonator sections can be minimized. By placing the coupling section on a separate substrate, in a different plane of orientation, the coupling effects are further reduced. The electromagnetic wave travels from resonator to resonator with a minimum of loss. Also, since the mounting substrate would typically be made of an inexpensive, relatively low dielectric material, a cost savings is realized by conserving the expensive high dielectric substrate material required for the resonator sections. Furthermore, since the air gap used in the coupling area is very small, the technique uses space efficiently.

The present invention overcomes the foregoing and other disadvantage and provides an improved microstrip filter which can be easily and inexpensively manufactured.

SUMMARY OF THE INVENTION

It is therefore an object of this invention to provide a microstrip hybrid filter which is constructed from a plurality of plug-in removably mountable sections.

It is another object of the present invention to provide a filter of the foregoing type which can be easily trimmed for a desired response.

It is another object of the present invention to provide a microstrip filter whose response can be altered after it is manufactured.

It is still another object of the invention to provide a filter whereby the coupling between resonator sections is effectively isolated from the resonators.

Microstrip filters embodying the preferred practice of the present invention include an improved hybrid filter with a plurality of removably mountable resonator modules with a ground plane on one side and a resonant conductor on the other side. The resonator modules attach to a mounting substrate having an insulating board with a ground plane on one side and a plurality of conductors on the other side. The mounting substrate further includes a means for releasably mounting the resonator modules and provides interconnection and coupling between the modules. The coupling between the modules is accomplished by pairs of parallel conductors which are in contact with the resonant elements with the parallel conductors being trimmable to alter the frequency response of the hybrid filter after it is assembled.

BRIEF DESCRIPTION OF THE DRAWINGS

The novel features of this invention are set forth with particularity in the appended claims. The invention itself, however, in its construction, together with additional objects and advantages thereof, will be best understood from the following description of specific embodiments when read in connection with the accompanying drawings, in which:

DESCRIPTION OF THE PREFERRED EMBODIMENT

Figure 1:
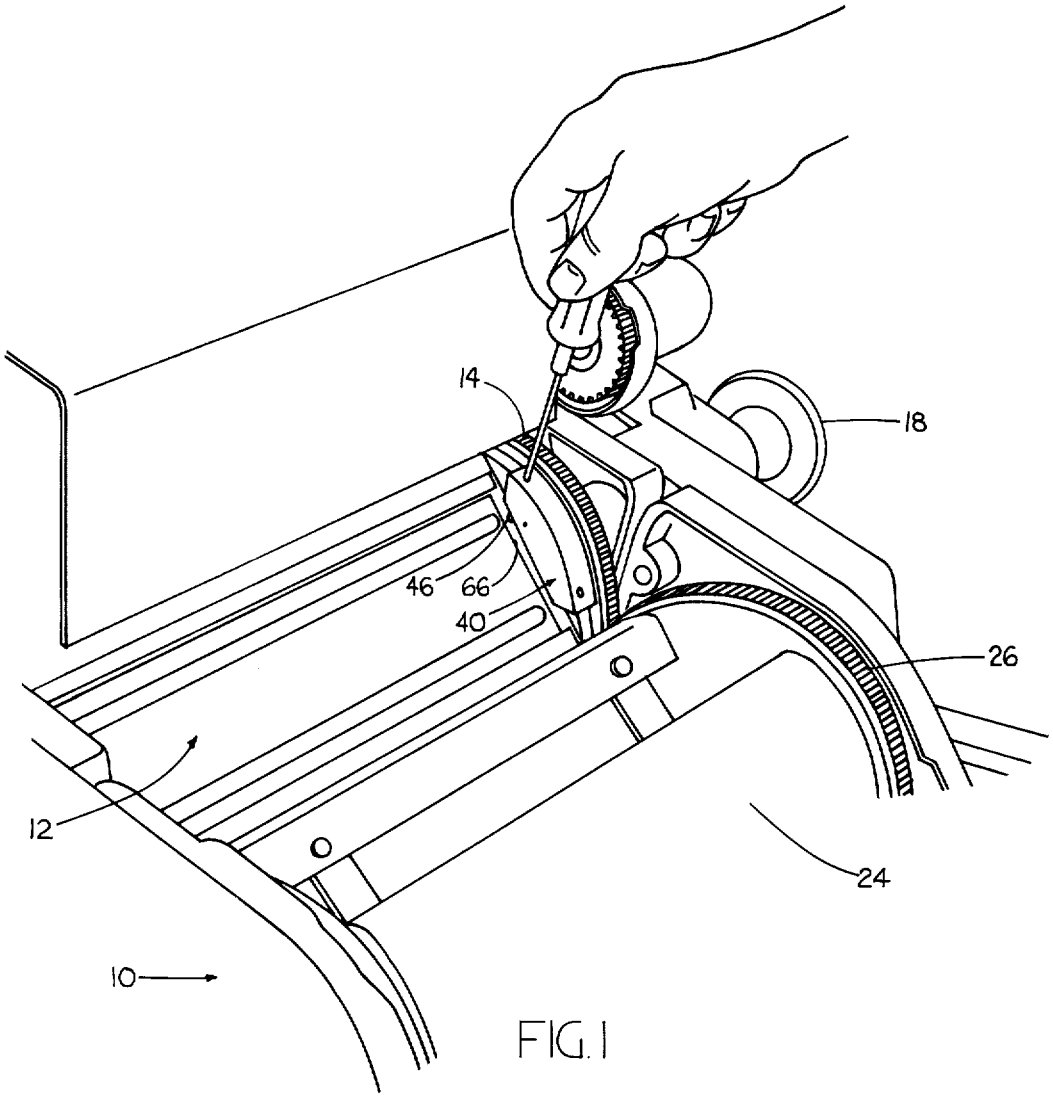
FIG. 1 is a view in perspective of a filter arrangement having a single resonator structure that is pluggable into an associated printed circuit board.

Referring now to the drawings, FIG. 1 shows a filter arrangement 10 which includes a hybrid resonator module 12. Module 12 comprises a single section hybrid resonantor on an insulating mounting substrate 13. As illustrated, each such resonator section is designed to mount perpendicular to the main substrate 17 although other orientations may well function satisfactorily. The hybrid resonator module 12 comprises a substrate 13, a first front conductor 14, a second rear conductor 15, two or more pins or legs 16 which protrude from the bottom surface of the module 12. The substrate for this device would typically be formed of a high dielectric material such as a ceramic. Other materials with a lower dielectric constant could be used with satisfactory results. These materials would include Duroid, a teflon filled fiber glass or Epsilam-10, a ceramic filled teflon. The conductors for the resonator structure may be formed by conventional printed circuit techniques such as a thick film screen process, although any printed circuit process could be used.

The hybrid resonator module 12 is configured as a grounded quarter wave resonator. This configuration requires that the first conductor 14 known as the resonator, be electrically connected on one end to the second conductor 15 known as the ground plane. The resonant frequency for this structure is determined through the following relationship;

$$L=(2n-1)/4\cdot\lambda \text{ (for a quarter wave resonator, } n=1)$$

where L is the physical length of the first conductor and λ is the wavelength of the desired frequency. It should be noted that many resonator structures, such as stripline could be utilized, and the invention is not limited to microstrip resonators, or quarter wave structures.

A second insulating board 17 provides the mounting and insulating means supporting the resonator. This board comprises a layer of insulating material 21, a first conductor known as the ground plane 19, and a plurality of conductors 18, which provide the input and output interconnection for the resonator section. The insulating board also has two openings 11 for receiving the pins 16. The pins 16 provide electrical connection between the ground plane on the first insulating board 13 with the ground plane on the second insulating board 17.

Figure 2:
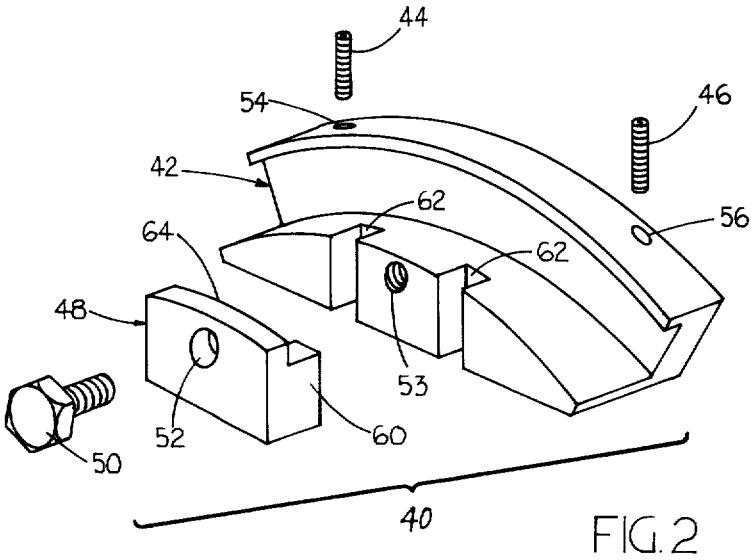
FIG. 2 is a view in perspective of a hybrid filter arrangement in which several hybrid resonators of FIG. 1 are included to comprise the present invention.

FIG. 2 shows the hybrid filter 20 of the present invention formed from a plurality of such hybrid resonators 12 with each resonator mounted parallel to each other and perpendicular to the mounting substrate structure 24. Coupling between the resonator sections is accomplished across a gap 22 formed by a metalization pattern of conductors 18 on the mounting substrate. The area 23 can then be trimmed to provide the desired coupling effect between stages. This feature could be used to control the bandwidth of the filter. It should be noted that other coupling techniques could be implemented although capacitive coupling is especially convenient in this application.

The electrical characteristics of the filter can be altered by interchanging resonators 12 or by trimming the length of the conductors forming the coupling gap 22. The trim area 23 can be affected by any suitable means, such as by laser or abrasive techniques.

It will be noted that in the configuration as shown in FIG. 2 the hybrid resonator module 12 are mounted parallel to one another but perpendicular to the insulating board 24. As such, the resonator element 14 themselves are separated at least on one side by a ground plane 15. This provides an effective shielding action and is yet another advantageous aspect of the present invention.

Figure 3:
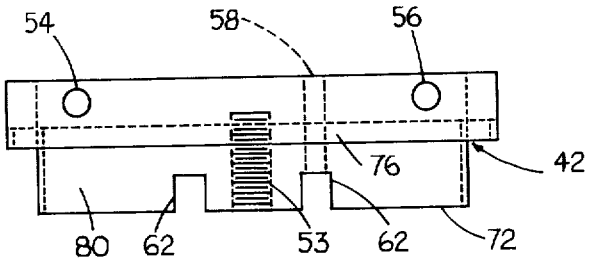
FIG. 3 is an electrical schematic for the "in band" equivalent circuit of a two-line filter.
Figure 4:
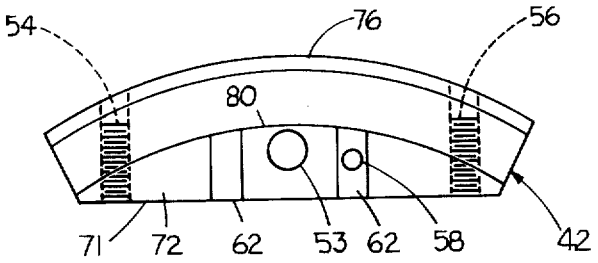
Figure 5:
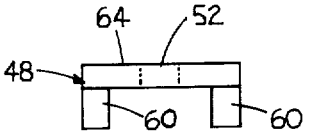
Figure 6:
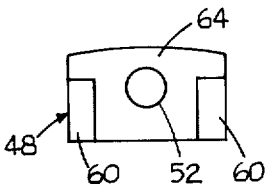
Figure 7:
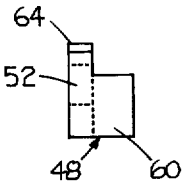
Figure 8:
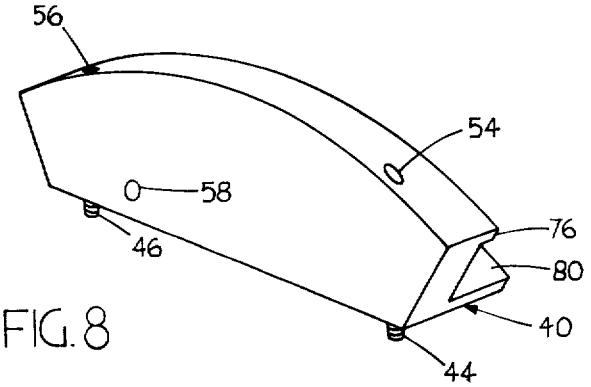
Figure 9:
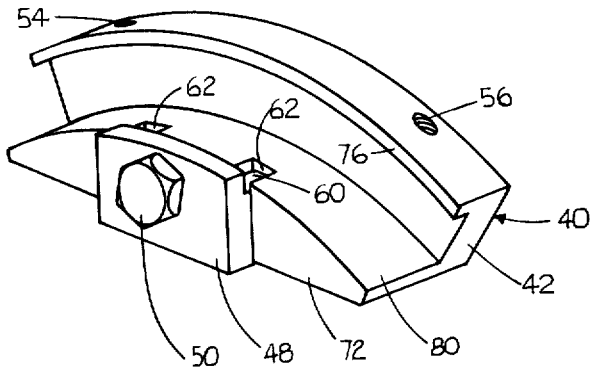
Figure 10:
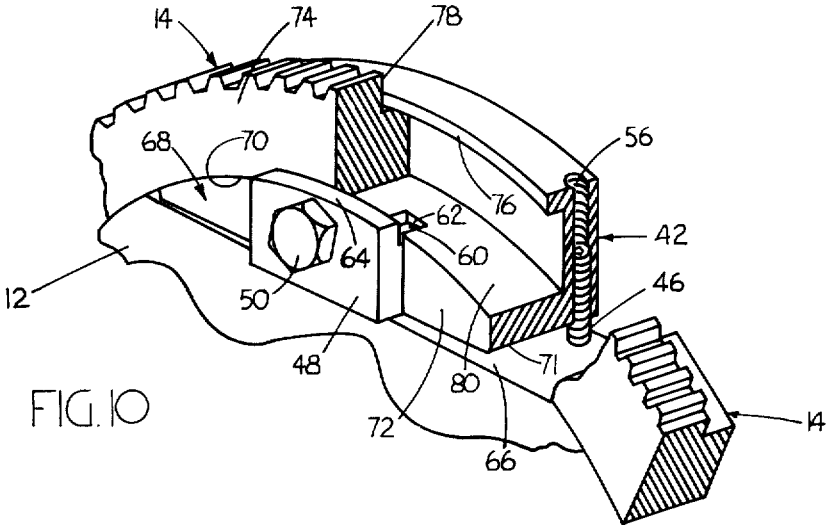
Figure 11:
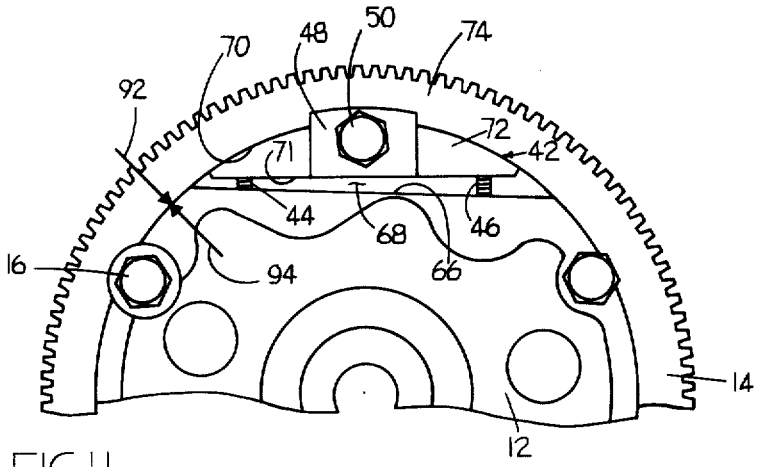
Figure 12:
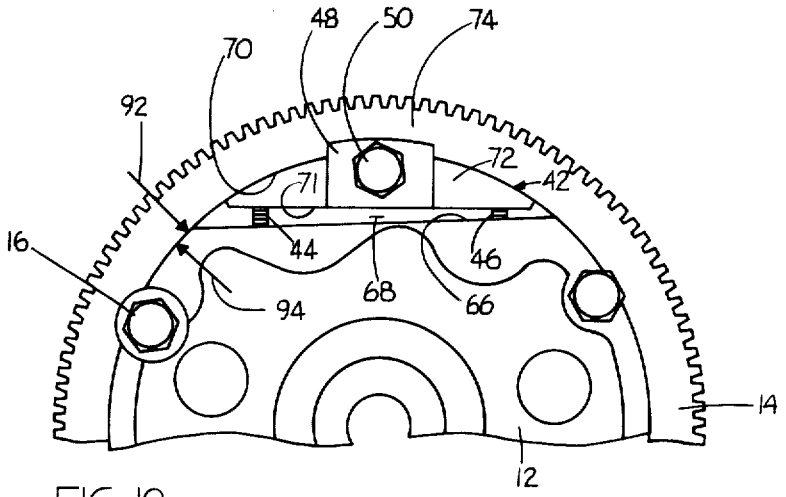
Figure 13:
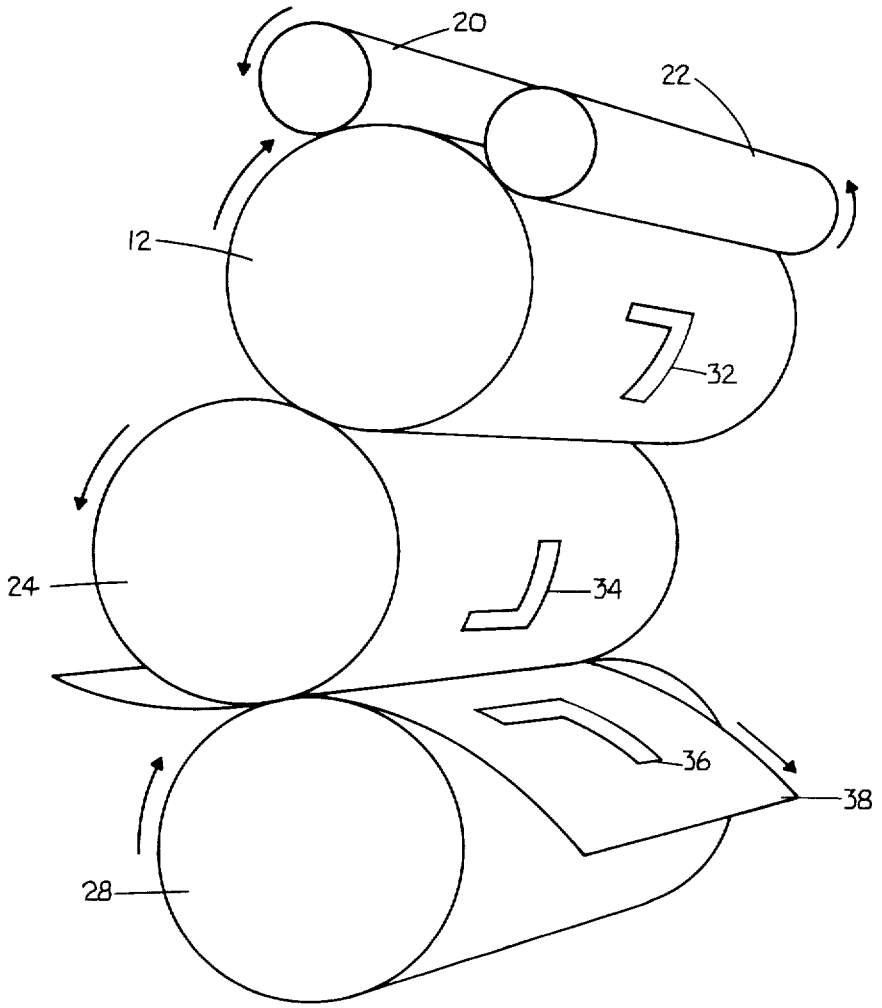
Figure 14:
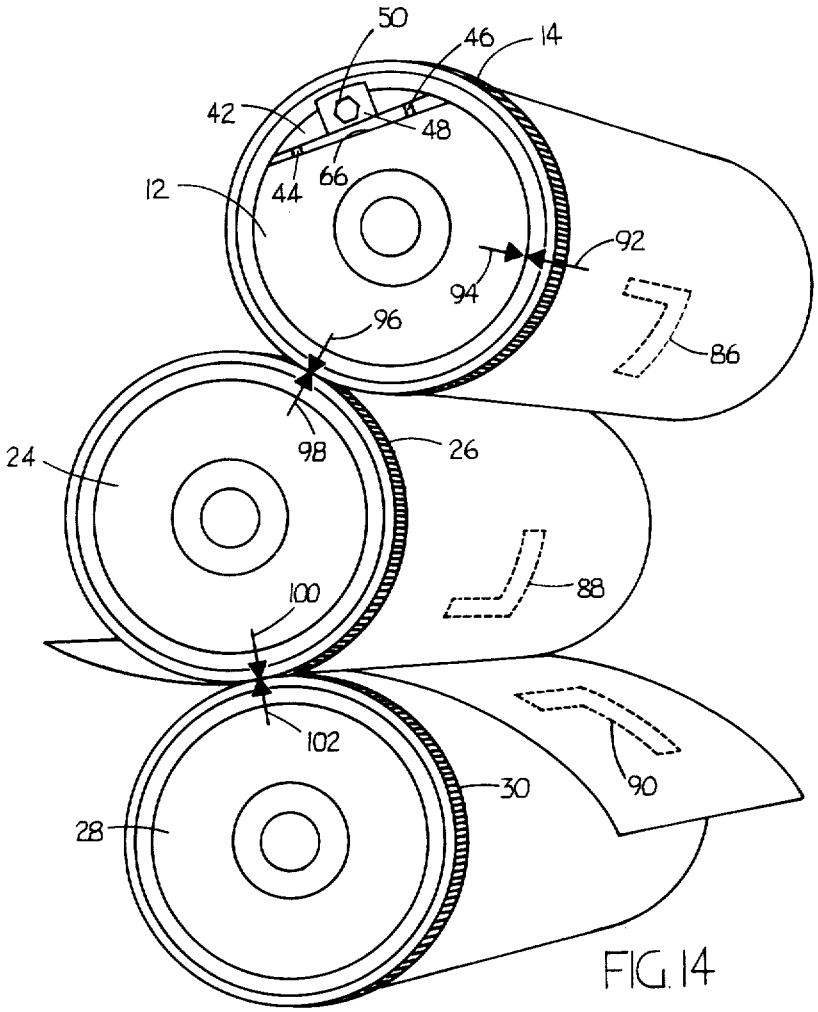
Figure 15:
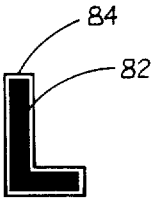
Figure 16:
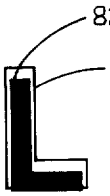
Figure 17:
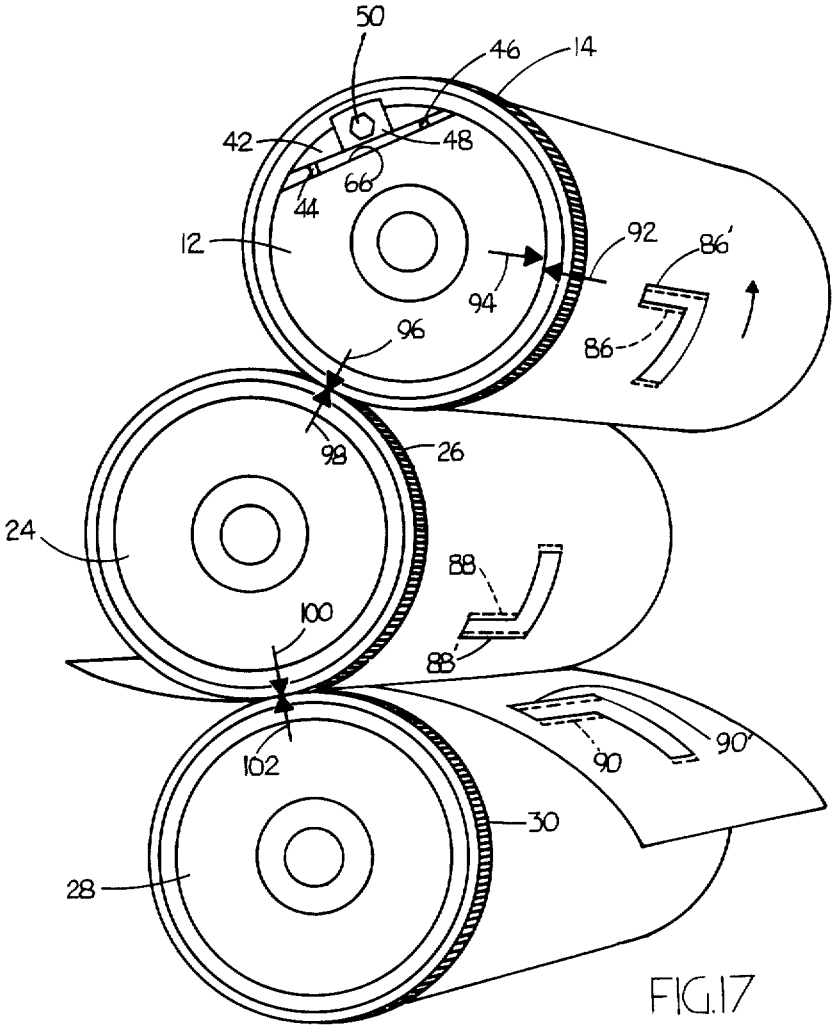

FIG. 3 show an electrical schematic for the equivalent "in band" electrical circuit. The hybrid resonantor modules 12 are represented as a parallel tuned circuit 12 and the coupling gap formed by the conductors 18 is represented by the capacitor 22.

The resulting filter structure can be modified after it has been manufactured and in its ultimate form, it is extremely small. This filter is of such a size that it can easily be incorporated into a larger hybrid structure.

The final structure provides a hybrid filter which is small, inexpensive and can be pretuned. This structure could then be used as is or incorporated into another hybrid structure.

What claimed is:

1. An improved hybrid filter arrangement, comprising in combination:

a plurality of removably mountable resonator modules including an insulating board with a ground plane on one side thereof and a resonant conductor on the other side;

a mounting substrate having an insulating board with a ground plane on one side and a plurality of conductors on the other side, said substrate further including means for releasably mounting said plurality of resonator modules in a manner to effect interconnection and coupling therebetween;

said coupling being accomplished by pairs of conductors on said substrate in proximity to one another along a length thereof at one end and being in electrical contact with a resonant conductor of a respective resonator module at the other end when said modules are mounted on said substrate;

said pairs of conductor being trimmable to alter the frequency response of said hybrid filter after the assembly thereof.

2. The apparatus of claim 1 wherein each resonator module is a microstrip.

3. The apparatus of claim 2 wherein resonator modules are mounted parallel to each other but perpendicular to the mounting substrate to provide effective shielding action between resonant conductors of said resonator modules.

4. The apparatus of claim 1 wherein said conductors in proximity to one another along a length thereof may be trimmed by a laser beam or an abrasive action.

5. The apparatus of claim 1 wherein said means for mounting said resonator modules on said mounting substrate includes connector legs on said resonator modules which are accommodated in apertures on said mounting substrate.

* * * * *

UNITED STATES PATENT AND TRADEMARK OFFICE

CERTIFICATE OF CORRECTION

PATENT NO. : 4,429,289

DATED : January 31, 1984

INVENTOR(S) : Robert J. Higgins, Jr.
Harvey N. Turner, Jr.

It is certified that error appears in the above-identified patent and that said Letters Patent is hereby corrected as shown below:

In column 4, line 31 (claim 1), delete "conductor" and insert --conductors--.

Signed and Sealed this

*Twenty-seventh* Day of *November 1984*

[SEAL]

*Attest:*

GERALD J. MOSSINGHOFF

*Attesting Officer*

*Commissioner of Patents and Trademarks*